US005333043A

United States Patent [19]

Yamada

[11] Patent Number: 5,333,043

[45] Date of Patent: Jul. 26, 1994

[54] IMAGE FORMING APPARATUS EQUIPPED WITH AUTOMATIC DOCUMENT FEEDER

[75] Inventor: Yasushi Yamada, Tachikawa, Japan

[73] Assignee: Konica Corporation, Tokyo, Japan

[21] Appl. No.: 42,000

[22] Filed: Apr. 2, 1993

[30] Foreign Application Priority Data

Apr. 16, 1992 [JP] Japan ..... 4-096712

[51] Int. Cl.[5] ..... G03G 15/00

[52] U.S. Cl. ..... 355/309; 271/3.1

[58] Field of Search ..... 355/309, 317, 311; 271/3, 3.1, 9, 10, 265, 266

[56] References Cited

U.S. PATENT DOCUMENTS 4,939,554 7/1990 Hirabayashi et al. ..... 355/317

4,952,977 8/1990 Kobayashi et al. ..... 355/309 X 5,118,089 6/1992 Yamada et al. ..... 271/3

*Primary Examiner*—Joan H. Pendegrass

*Attorney, Agent, or Firm*—Finnegan, Henderson, Farabow, Garrett & Dunner

[57] ABSTRACT

An apparatus for conveying a plurality of document on a document stand to a scanning section one by one along a document passage on which a waiting position is provided so that, when a first document is located on the scanning means, a second document is located on the waiting position. A sensor to detect the presence of a document on the document stand is arranged in such manner that, when the second document is located on the waiting position, the trailing edge of the second document have passed over the detecting means.

2 Claims, 8 Drawing Sheets

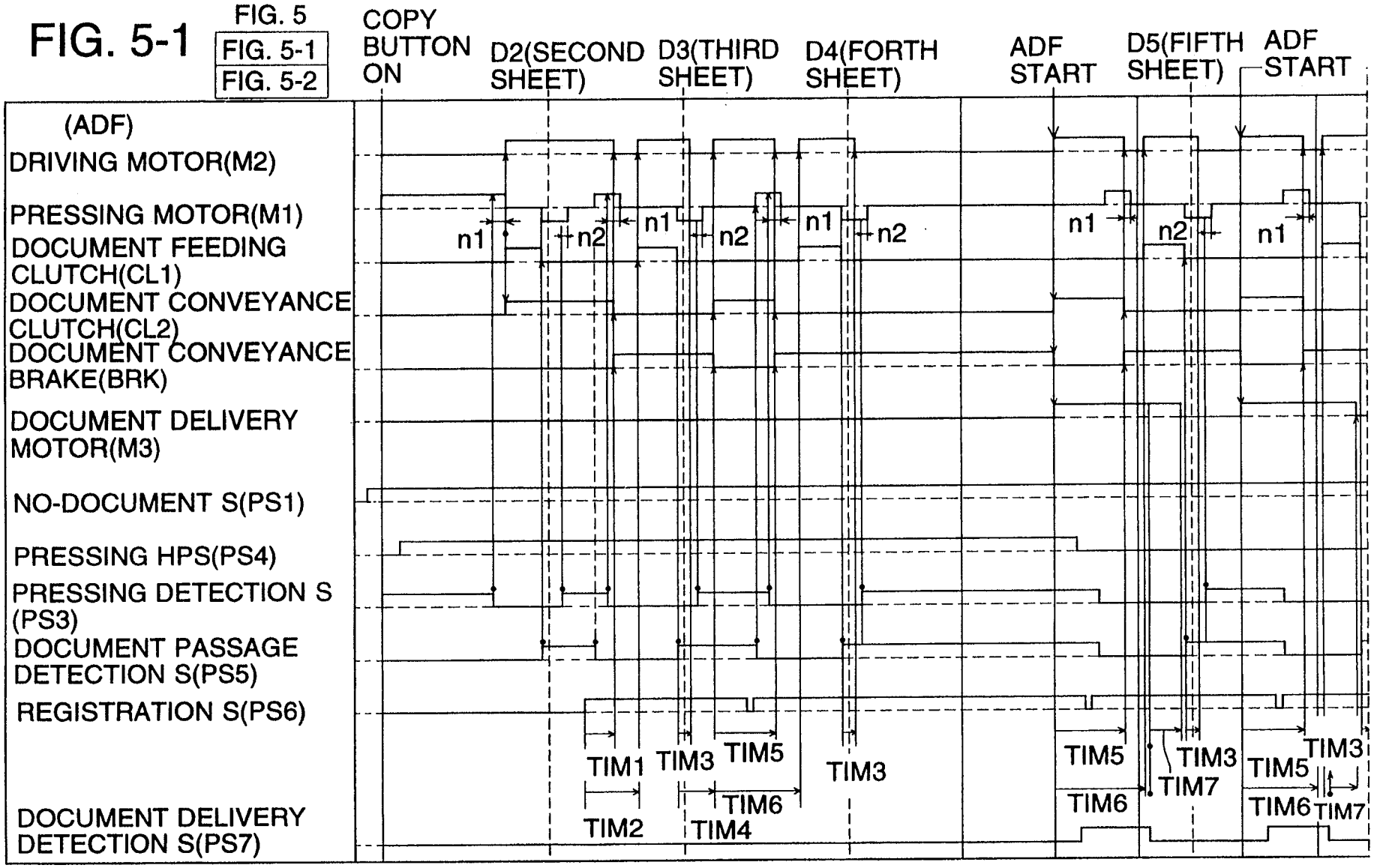
FIG. 5-1
FIG. 5
FIG. 5-1
FIG. 5-2
COPY BUTTON ON
D2(SECOND SHEET)
D3(THIRD SHEET)
D4(FORTH SHEET)
ADF START
D5(FIFTH SHEET)
ADF START
(ADF)
DRIVING MOTOR(M2)
PRESSING MOTOR(M1)
DOCUMENT FEEDING CLUTCH(CL1)
DOCUMENT CONVEYANCE CLUTCH(CL2)
DOCUMENT CONVEYANCE BRAKE(BRK)
DOCUMENT DELIVERY MOTOR(M3)
NO-DOCUMENT S(PS1)
PRESSING HPS(PS4)
PRESSING DETECTION S (PS3)
DOCUMENT PASSAGE DETECTION S(PS5)
REGISTRATION S(PS6)
DOCUMENT DELIVERY DETECTION S(PS7)
n1
n2
TIM1
TIM2
TIM3
TIM4
TIM5
TIM6
TIM7

IMAGE FORMING APPARATUS EQUIPPED WITH AUTOMATIC DOCUMENT FEEDER

BACKGROUND OF THE INVENTION

The present invention relates to an improvement of an automatic document feeder which is provided to an image forming apparatus such as an electrophotographic copying machine.

An automatic document feeder (ADF) is generally provided on a platen glass of an image exposure section of a copying machine or the like. In an optical system travelling type copying machine provided with the automatic document feeder, documents which are fed one by one from a document stacking tray (a stack section) on which documents are stacked, by the automatic document feeder, are fed to a platen glass by a conveyance belt, exposed by an exposure lamp provided in the copying machine main body, and then conveyed onto a document delivery tray.

A conventional exchanging operation of a document located on a platen glass by the automatic document feeder is as follows. After a document delivery sensor detects that a document on a platen has been delivered, a subsequent document is fed from the stack section to the platen glass and stopped at a predetermined position. Therefore, a long document exchange time is necessary. Accordingly, a long copy-processing time is necessary, so that copying productivity is lowered.

When a document is automatically fed to and delivered from the platen using the automatic document feeder, and the document is exchanged within the returning time of the optical scanning system of the copying machine main body, the copying productivity is 100%, and long copy-processing time is not necessary. For this purpose, it is necessary that speed of the document conveyance from a document double feeding protection position to a document stop position on the platen glass is increased. However, when the document conveyance speed is increased, the following disadvantages are generated: a large motor is necessary; the consumed power is increased; noises are generated; a conveyance belt is worn down; the degree of document damage is increased; and the document separation property is lowered.

In order to solve the foregoing problems, conventional technology of an automatic document feeder by which the document exchange time is decreased without increasing the document conveyance speed, is disclosed in Japanese Patent Publication Open to Public Inspection No. 236136/1989.

The operation of the document feeder is as follows: a first document is fed to a predetermined position on the platen glass; successively, a second document is fed to an upstream position, which is not on the platen glass, adjoining the predetermined position; next, the first document, the image of which has been read out, is conveyed to a position to which the document can be conveyed and which is downstream adjoining the predetermined position on the platen glass, by a conveyance means; at the same time, the second document is conveyed to the predetermined position on the platen glass; and for a third document and documents after that, the foregoing operations are repeated and the document is successively conveyed and stopped. (A flying document feeding method).

However, in the foregoing document feeding method, the existence of the subsequent document can not be confirmed until the preceding document has been completely fed out. Therefore, when the number of copying sheets is small, a recording sheet feeding path is long, and a recording sheet is fed after the existence of the subsequent document has been confirmed, the speed of copying operation is practically decreased.

Further, in a document feeding method of the copying machine disclosed in Japanese Patent Publication Open to Public Inspection No. 140364/1985, this method is a three document simultaneous feeding method, and when documents which are smaller than a certain size, are continuously copied, the copying speed can be increased. In this case also, the existence of the subsequent document can not be confirmed until the preceding document has been fed out.

Further, in the copying machine equipped with the automatic document feeder, in the case of a side loading type sheet feeding means in which a sheet feeding cassette is provided to the side of the copying machine main body, the distance from a leading edge of the sheet feeding cassette to a registration roller of a feeding apparatus of the copying machine main body is comparatively close. Therefore, the time from the generation of a document size detection signal of documents stacked on a stacking tray in the automatic document feeder to the time at which a recording sheet is taken out from the corresponding sheet feeding cassette and conveyed to the registration roller, is approximate to the time in which the document is conveyed to a stop position on the platen glass. Therefore, when documents with a plurality of sizes are stacked together, it is not necessary to particularly reduce the document exchanging time.

However, in a recording sheet feeding apparatus in which the distance from a feeding start position (a leading edge of a recording sheet) from a sheet feeding cassette to a registration roller is large, for example, in a front loading multiple stage sheet feeding cassette type (a front loading type as shown in FIG. 1) recording sheet feeding apparatus, or a large capacity sheet feeding tray type (LCT) recording sheet feeding apparatus, recording sheet feeding time, in which a recording sheet fed from a sheet feeding cassette (or a sheet feeding tray) is conveyed to a registration roller, is increased. Therefore, even when the subsequent document arrives at a predetermined position on the platen glass, a corresponding recording sheet does not arrive at a predetermined position in an image forming section, so that the copying productivity={the number of copied sheets per minute (CPM) / the number of documents processed per minute (OPM)} is decreased. Especially, in a high performance copying machine in which an image formation processing speed and a document conveyance speed are increased and documents can be processed at high speed, the delay of the foregoing recording sheet feeding is a problem.

Further, in a copying machine in which the subsequent document is fed to an intermediate document feeding path from a document stacking tray provided in the document feeding position to a platen glass, and the document stands-by there for the next processing, the subsequent document size can be detected on the way to the intermediate path, and therefore the subsequent recording sheet corresponding to the size can be fed previously. However in this type of apparatus, a document feeding path is long, the size of the apparatus is large, the document can not be fed satisfactorily, or document jamming can hardly be processed, which is a problem.

SUMMARY OF THE INVENTION

The object of the present invention is to solve the foregoing problems at the time of document feeding in an image forming apparatus equipped with an automatic document feeder, to shorten the document exchanging time and to improve the recording sheet feeding timing, while maintaining the document feeding reliability.

That is, the object of the present invention is as follows. During so-called flying sheet feeding in which the subsequent document is fed to a temporary stop position while the preceding document is exposed, the existence of the subsequent document is detected. The recording sheet feeding timing is thereby improved, and therefore copying productivity is increased.

The foregoing object can be accomplished by an image forming apparatus equipped with an automatic document feeder, comprising: a document stack tray on which a plurality of documents can be stacked; detection means by which the existence of the document on the document stack tray is detected; separation feeding means by which the stacked documents are separated and fed one by one; at least a pair of feeding rollers positioned downstream of the feeding direction of the separation feeding means; a document information reading section positioned downstream of the feeding rollers; feeding means by which the document is fed to and delivered from the reading section; and delivery means by which the document delivered downstream of the reading section by the feeding means is successively delivered. The image forming apparatus also comprises image forming means by which the document information read by the reading section is recorded on a predetermined number of recording sheets; a recording sheet feeding tray in which a plurality of recording sheets can be loaded; and recording sheet feeding means by which the recording sheets are separated and fed from the recording sheet feeding tray to an image forming position, wherein the document existence detection means and a document stand-by position are arranged in the manner that a trailing edge of the document passes through the document existence detection means before a predetermined sized document stops at the document stand-by position close to the separation feeding means of the automatic document feeder.

Further, the object of the present invention is to provide an image forming apparatus equipped with an automatic document feeder characterized in that: before a predetermined sized document stops at the document stand-by position which is closest to the separation feeding means, a recording sheet on which an image is recorded in the predetermined timing is separated and fed when the document detection means detects the existence of documents on the stacking tray.

BRIEF DESCRIPTION OF THE DRAWINGS

FIGS. 5-1 and 5-2 are time charts of a document feeding and conveying process.

DETAILED DESCRIPTION OF THE PREFERRED EMBODIMENT

Referring to attached drawings, an embodiment of the present invention will be described in detail as follows.

Figure 1:
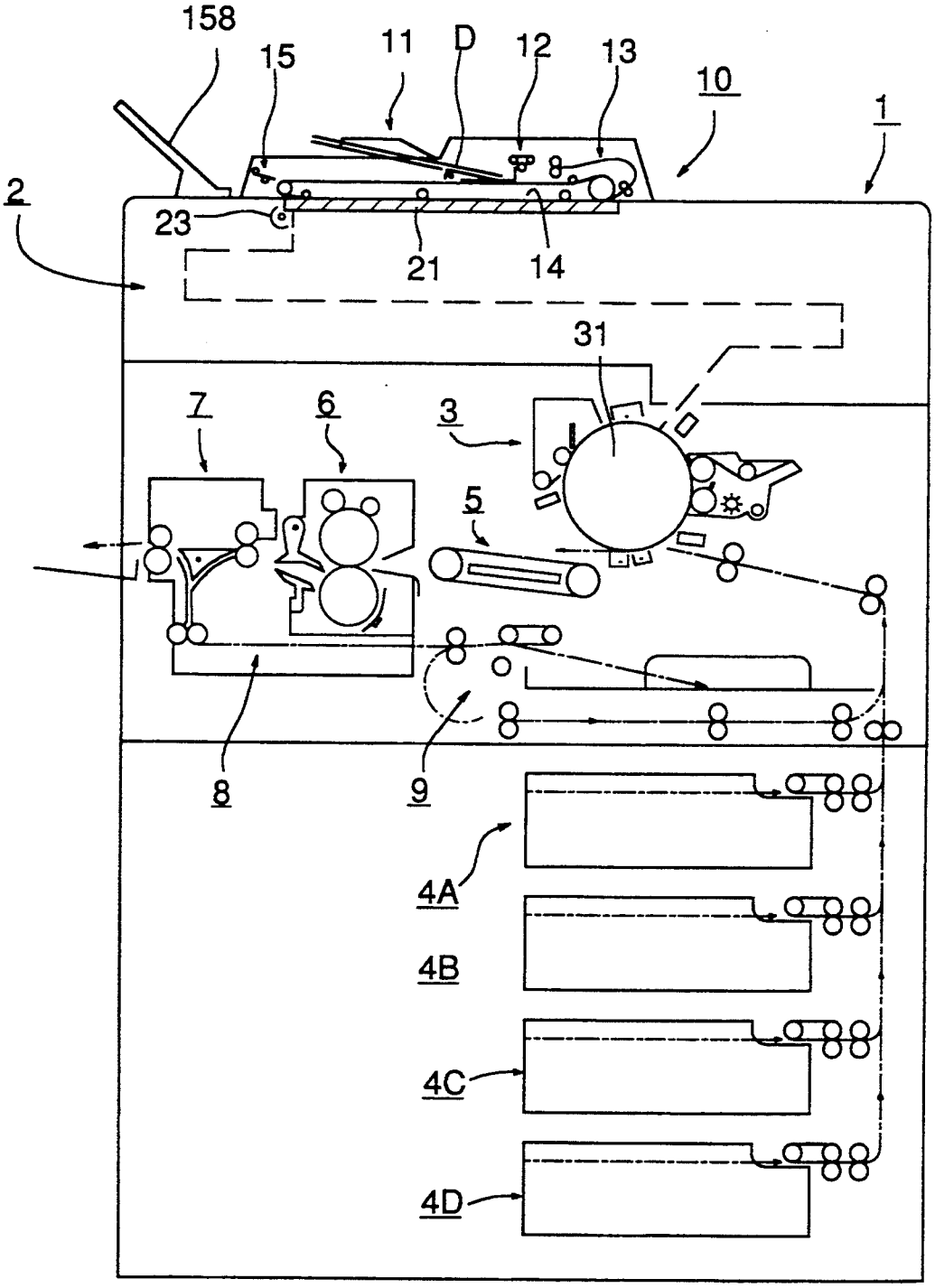
FIG. 1 is a view showing an entire structure of an image recording apparatus equipped with the automatic document feeder according to the present invention.

FIG. 1 is a view showing an entire structure of an image forming apparatus ( copying machine ) equipped with the automatic document feeder according to the present invention. In the drawing, numeral 1 is a copying machine main body, numeral 2 is an optical scanning exposure system, numeral 3 is an image forming means provided around a photoreceptor drum 31, numerals 4A, 4B, 4C, 4D are each recording sheet feeding means (a sheet feeding means), numeral 5 is recording sheet conveying means, numeral 6 is a fixing unit, numeral 7 is reversal delivery sheet switching means, numeral 8 is reversal conveyance means, numeral 9 is two-sided recording sheet conveyance means (ADU), and numeral 10 is an automatic document feeder (ADF).

Figure 2:
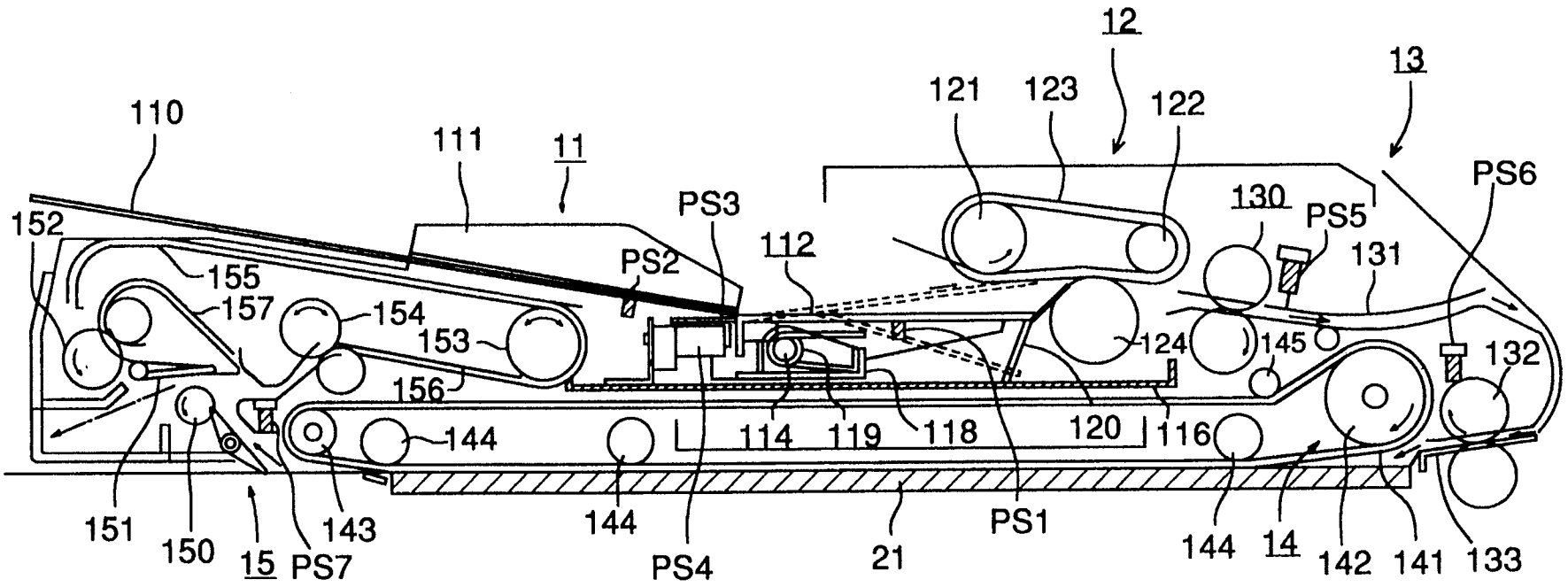
FIG. 2 is a sectional view of the automatic document feeder according to the present invention.
Figure 3:
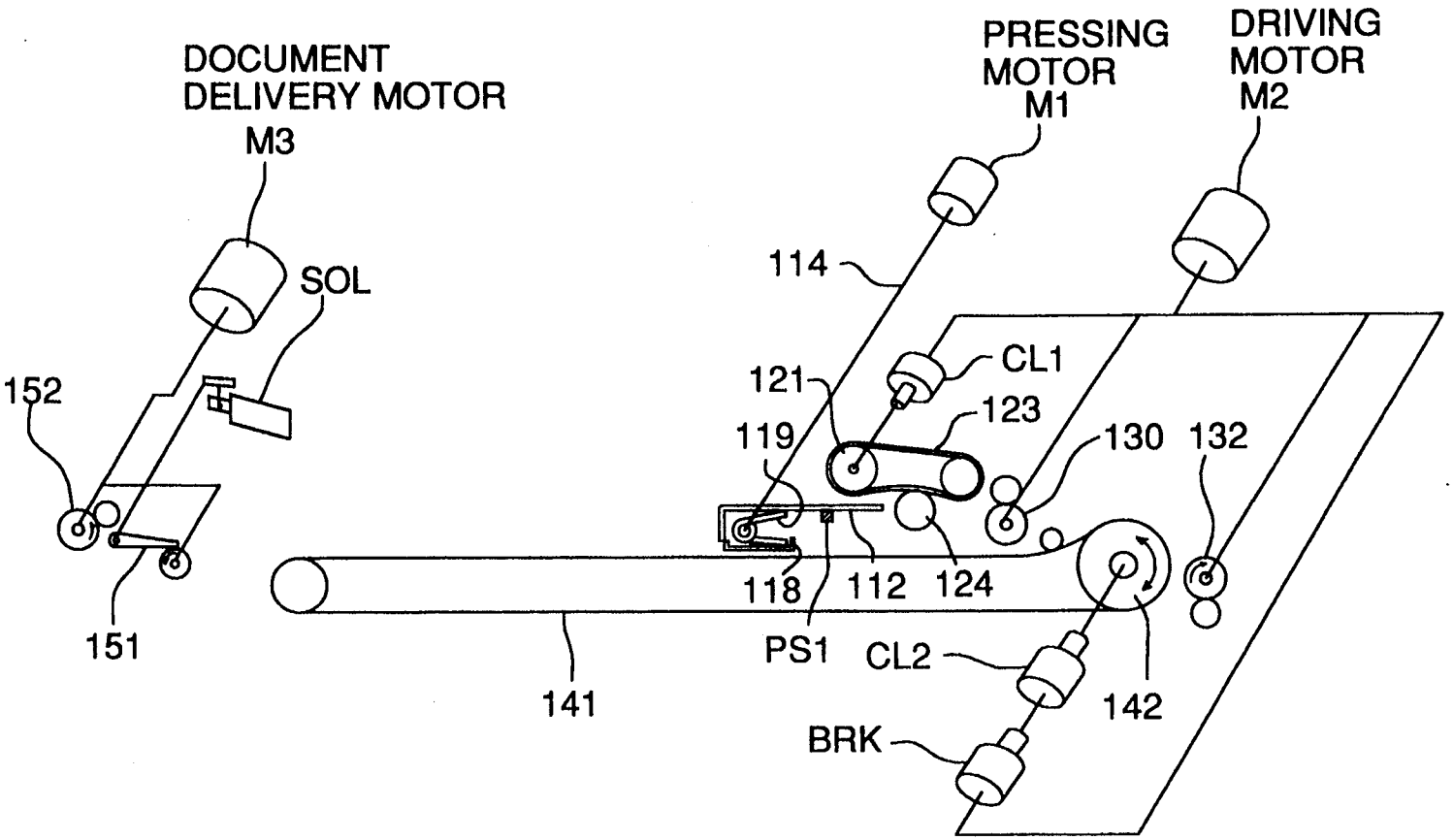
FIG. 3 is a view showing a structure of a drive system (a driving power transmission system) of the automatic document feeder.
Figure 4:
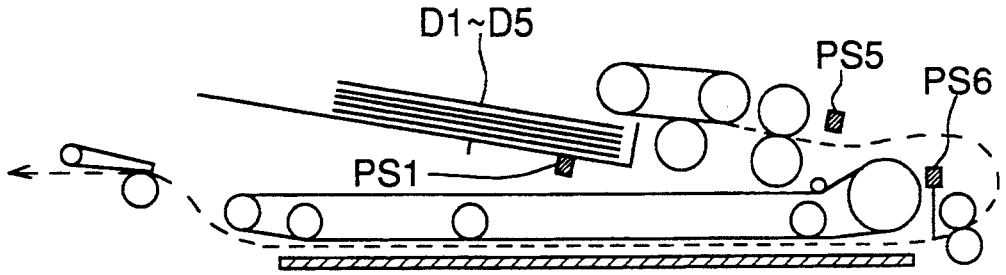
FIG. 4(A) to FIG. 4(G) are illustrations explaining operation processes of feeding, conveying, and delivering of a plurality of documents.
Figure 4:
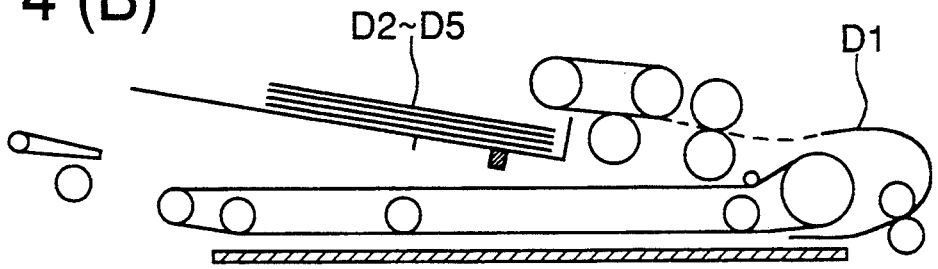
Figure 4:
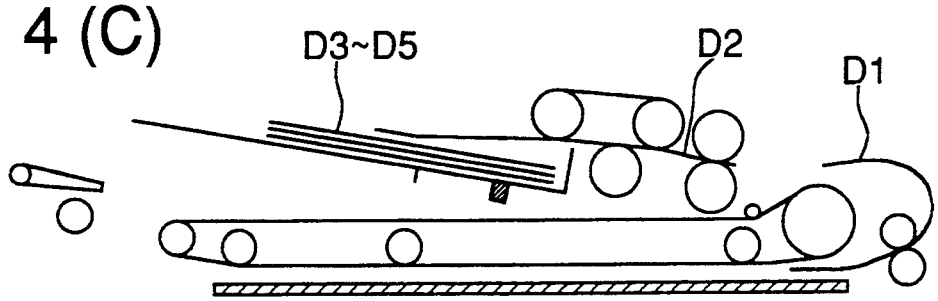
Figure 4:
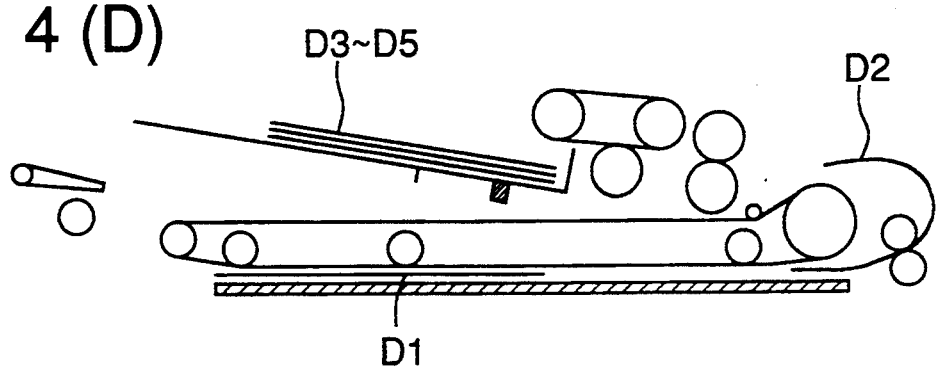
Figure 4:
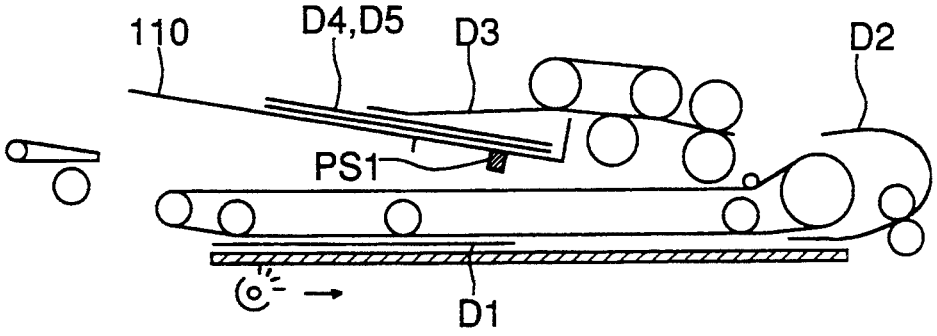
Figure 4:
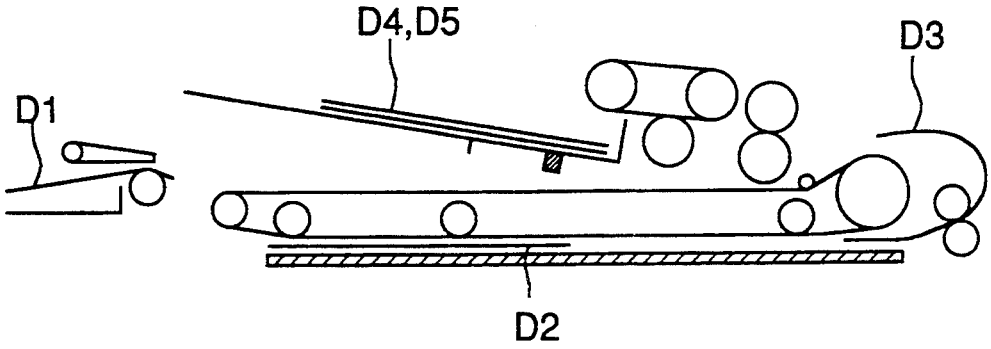
Figure 4:
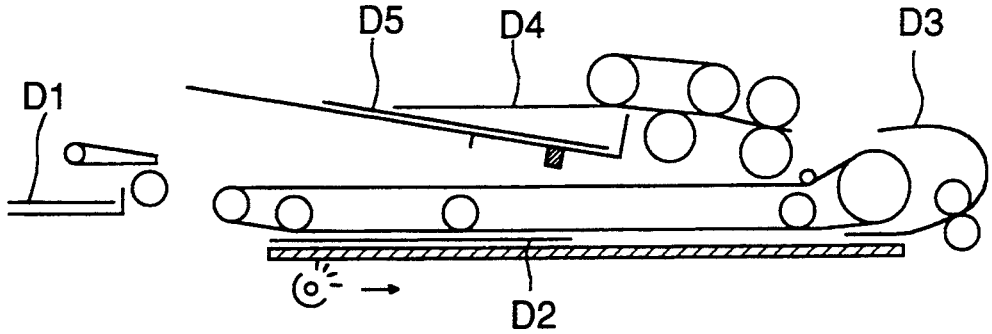

FIG. 2 is a sectional view of the automatic document feeder 10 according to the present invention, and FIG. 3 is a view showing a structure of a driving system (a driving power transmission system) of the automatic document feeder. The automatic document feeder 10 is provided on a copying machine main body 1 as shown in FIG. 1. The automatic document feeder 10 comprises: a document stacking section 11 on which a stack of documents is stacked; a document sheet feeding section 12 by which a document D is separated from the stack of documents and fed; an intermediate conveyance section 13 and conveyance means 14 by which the document D fed from the document sheet feeding section 12 is conveyed to a predetermined position on a platen glass 21; and a reversal sheet delivery section 15 by which the document D, fed from the conveyance means 14 after image exposure has been completed, is delivered to a delivery tray or an after-processing apparatus, and the document located on an image exposure section is reversed and conveyed again to a platen glass 21.

A stack tray (a document stacking tray) 110 on which a stack of documents is stacked is provided in the document stacking section 11, and a width regulation plate 111 by which the width of documents is regulated is movably provided on the stack tray 110.

When the stack of documents D is stacked on the stack tray 110, the existence of the document on the stack tray 110 is detected by document existence detection means (a no-document sensor) PS1, and an ADF mode is displayed on a control panel of the copying machine main body 1. A non-contact sensor can be used as the document existence detection means. When the stack of documents is stacked at a predetermined position, sizes of documents (B5 to A3) are detected by a document size sensor PS2, and this information is inputted into a control section of the copying machine main body 1.

A movable pressing plate 112 can oscillate around an oscillation shaft 114 on a leading edge side downstream of a document conveyance direction of the stack tray 110. A drive plate 118 is screwed on the oscillation shaft 114 and can integrally oscillate with the shaft 114. An elastic deformable member (for example, a torsion spring) 119 is wound around the oscillation shaft 114, its both ends contact with the drive plate 118 with pressure, and its center can contact with the movable pressing plate 112 with pressure. Two actuator sections are provided on the drive plate 118. One actuator section turns on and off an optical path of a pressing sensor (for example, a photo-interrupter) PS3 which is provided on the movable pressing plate 112. The other actuator section turns on and off an optical path of a sensor (for example, a photo-interrupter) provided on a fixed base plate 116, and detects a home position of the drive plate 118.

A document sheet feeding section 12 is provided downstream of the document feeding direction of the movable pressing plate 112. The document sheet feeding section 12 is composed of: a document leading edge stopper 120; a drive roller 121; a roller 122; a feed belt 123 around both rollers and rotated thereby; and a reverse roller 124 for double feeding protection which is positioned under the belt. The drive force of a drive motor M2 is transmitted to the drive roller 121 through an electromagnetic clutch CL1.

The intermediate conveyance section 13 is provided downstream of the document conveyance direction of the document sheet feeding section 12. The intermediate conveyance section 13 is composed of: a pair of first intermediate conveyance rollers 130 which are driven forwardly in the drawing; a document passage detection sensor PS5; a bent guide plate 131; and a pair of second intermediate conveyance rollers 132 which are driven forwardly and reversely. The intermediate conveyance section 13 forms a conveyance path along which the document D fed from the document sheet feeding section is conveyed to one end of the platen glass 21.

On the surface of the platen glass 21, the conveyance belt 141 is rotatably provided around the drive roller 142, the roller 143, and three document press rollers 144, and a tension roller 145 is contacted with the outer surface of the belt. A clutch CL2 and a brake BRK are supported on the shaft of the drive roller 142, and operated by the driving force of the drive motor M2.

The reversal sheet delivery section 15 is composed of: a sheet delivery roller 150; a switching claw 151; a plurality of conveyance rollers 152, 153, 154; and guide plates 155, 156, and 157. The sheet delivery roller 150, and conveyance rollers 152, 153, 154 are driven by a sheet delivery motor M3. The sheet delivery roller 150 and the conveyance roller 152 are driven forwardly in the drawing, and the conveyance rollers 153 and 154 are driven forwardly and reversely. The switching claw 151 is driven by a solenoid SOL.

The document existence detection means (no-document sensor) PS1 is provided at a predetermined position on the movable pressing plate 1-12 near the double feeding protection reverse roller 124 in the document sheet feeding section 12. The sensor PS1 is set in a position where the trailing edge of the document passes the sensor PS1 and the document stands by when the document stacked on the document sheet stacking tray is fed by the flying document feeding operation.

Figures 2, 5:
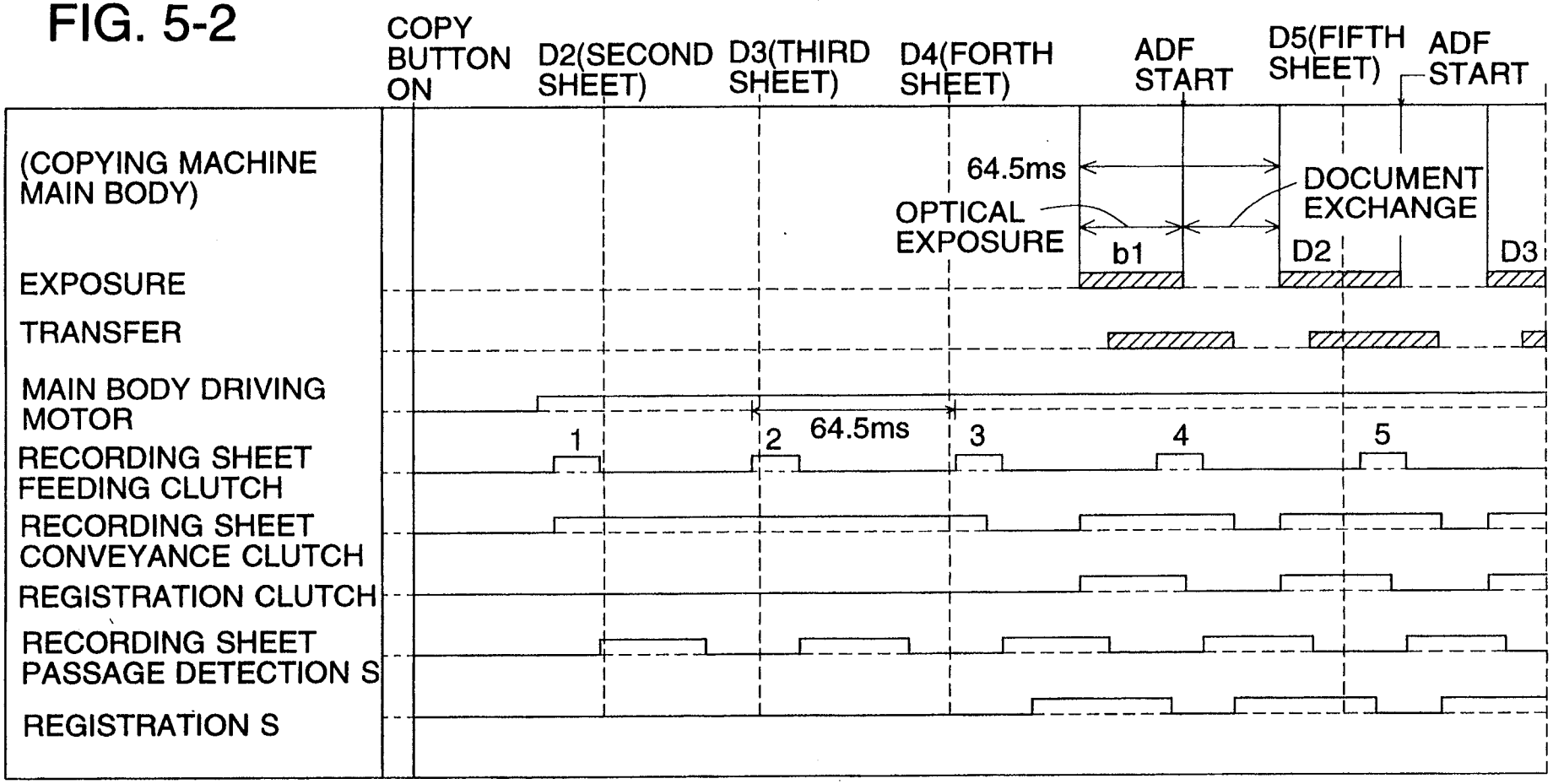

FIGS. 4(A)to (G) are illustrations explaining operating processes of feeding, conveying, and delivering of a plurality of small sized documents D1 to D5, and the broken line in the drawings indicates a conveyance path of the document D. FIG. 5 is a time chart showing a document feeding operation process in the automatic document feeder and a recording sheet feeding process in the copying machine main body.

A document feeding operation of small sized documents (size A4, size B5) will be explained as follows.

(1) Under the conditions in FIG. 2, when a main switch in the copying machine main body 1 is turned on, a pressing motor M1 is rotated, an initial stop position of the movable pressing plate 112 is detected by a pressing home position sensor PS4, and the pressing motor M1 is stopped. That is, the home position sensor is turned on at the home position. When a main switch is turned on and the home position sensor PS4 is turned off, the pressing motor M1 is rotated in the reverse direction. Then, it is detected that the home position sensor PS4 is turned on, and the pressing motor M1 is stopped and the driving plate 118 and the movable pressing plate 112 are stopped at the initial position, which is the lowest position. When the home position sensor PS4 is turned on, the pressing motor M1 is rotated forwardly once, and the home position sensor PS4 is turned off. Next, when the motor M1 is rotated reversely, and the sensor PS4 is turned on, the motor M1 is stopped and the driving plate 118 and the movable pressing plate 112 are stopped at the home position. The foregoing is effective for absorbing time lag of the driving gear or a turning-on operation of the sensor. At the stop position in the home position, a clearance, in which a predetermined maximum amount of the stack of documents D can be accommodated, is maintained.

(2) When the stack of the documents D is stacked on the stack tray 110 and the movable pressing plate 112, the document set sensor (no-document sensor) PS1 is turned on, and the mode is changed to an ADF mode. At the same time, the document size sensor PS2, by which the width of the document is detected, is turned on and the size of the document is detected.

(3) When a copy button is pressed and turned on, automatic document feeding and copying operations can be started, the pressing motor (stepping motor) M1 is started, the movable pressing plate 112 is swingingly rotated through the driving plate 118 fixed to the oscillating shaft 114, and the spring 119, and the leading edge of the movable pressing plate 112 is elevated, and the stack of documents D stacked on the plate is elevated. In this elevation process, an oscillation angle of the oscillation shaft 114 is pulse-counted by a rotary encoder.

(4) When the upper surface of the stack of documents D stacked on the movable pressing plate 112 is contacted with the outer peripheral surface of the feed belt 123, the movable pressing plate 112 is stopped under the condition that the stack of documents is held. The driving plate 118 is further driven and rotated counterclockwise while compressing the torsion spring 119, and then, the space between the movable pressing plate 112 and the driving plate 118 is reduced.

(5) When the space reaches a predetermined value, the following operations are conducted. An actuator section located at one end of the driving plate 118 turns on the pressing sensor PS3 fixed onto the movable pressing plate 112; and the pressure of the movable pressing plate 112 is an initial setting pressure (for example, 50 g). The pressing force is further increased when the driving plate 118 is driven. The document D is pressure-contacted with the feeding belt 123 by a predetermined pressing force (for example, 100 g) of the movable pressing plate 112; and after a predetermined pressing force has been reached, the pressing motor M1 is stopped (count n1). Due to the foregoing operations, preparation for document feeding is completed and a document feeding operation is started.

(6) At almost the same time when the pressing motor M1 is stopped, the drive motor (a main motor) M2 is turned on, and at the same time, the sheet feeding clutch CL1 and the conveyance clutch CL2 are turned on, so that the document feeding operation can be started. That is, documents in the upper layer are fed by the feeding belt 123 which is started rotating by the driving force of the drive motor M2, and further, only the uppermost document D1 of the plurality of documents which are fed by the reverse roller 124 is separated and fed. The document D1 separated and fed is conveyed in the following manner. The document D1 is nip-conveyed to a pair of the first intermediate conveyance rollers 130. When the leading edge of the document D1 crosses the document passage detection sensor PS5, the clutch CL1 by which the drive roller 121 is driven is turned off. The feeding belt 123 is idly rotated until the trailing edge of the document D1 passes the sensor PS5 and then the feeding belt 123 is stopped. The document D1 is still conveyed by the pair of the first intermediate rollers 130.

When the document passage detection sensor PS5 is turned on, the pressing motor M1 is switched to rotate in the reverse direction, the driving plate 118 and the movable pressing plate 112 are lowered, and pressing is released.

When the home position sensor PS4 detects that the driving plate is returned to the initial position, the pressing motor M1 is stopped. When a plurality of documents are successively fed, the driving plate 118 and the movable pressing plate 112 are not returned to the home position, and the reverse rotation of the pressing motor M1 is stopped after pulses n2 are counted after the pressure detection sensor PS3 has generated the detection signal, and then the lowering operations of the driving plate 118 and the movable pressing plate 112 are stopped at the intermediate position.

When the document passage detection sensor PS5 is turned on after the trailing edge of the first document D1 has passed, the pressing motor M1 is turned on according to the detection signal, and the pressing operation is started. The driving plate 118 and the movable pressing plate 112 are elevated and the pressing operation onto the subsequent document is started.

The passage of the leading edge of the first document D1 which is fed by the separation and feeding means and conveyed by the pair of the intermediate conveyance rollers 130, is detected by the document passage detection sensor PS5. Next, the document D1 passes through the guide plates 131, and is conveyed by the pair of the second intermediate conveyance rollers 132 provided downstream of the guide plates, and further, the document D1 passes through the guide plates 133 provided downstream of the rollers 132. After that, the document D1 passes through a registration sensor PS6 and is stopped. (Refer to FIG. 4 (B).)

(7) Next, when a timer TIM2 is turned off, the document sheet feeding clutch CL1 is turned on. At the same time, the driving motor M2 is rotated and the feeding belt 123 is rotated. The subsequent document D2 is fed, and nipped by the pair of the first intermediate conveyance rollers 130, and after that, the document D2 is temporarily stopped. While the document D2 is conveyed, the conveyance clutch CL2 is turned off, and accordingly, the preceding document D1 is stopped at a predetermined position upstream of the platen glass 21. (Refer to FIG. 4 (C).)

While the document D1 is stopped, the distance between the leading edge or trailing edge of the preceding document D1 and the leading edge of the subsequent document D2 is set to a predetermined value.

(8) When a timer TIM4 is turned off, the document D1 is operated in the following manner. The driving motor M2 and the conveyance clutch CL2 are turned on; and the document D1 is sandwiched between the rotating conveyance belt 141 and the platen glass 21 in the conveyance means 14. After the passage of the leading edge of the document has been detected by the registration sensor PS6, the driving motor M2 is stopped when a timer TIM5 is turned off. At the same time, the conveyance clutch CL2 is turned off, and a conveyance brake BRK is operated and the conveyance belt 141 is stopped. The document D1 is stopped at a predetermined position on the platen glass 21. (Refer to FIG. 4 (D).)

In this period of time, the document D2 is conveyed through the guide plates 131 by the pairs of intermediate conveyance rollers 130 and 132, and moves almost by the same distance as that of D1. The leading edge of the document D2 stops in the vicinity of the registration sensor PS6, and stands by for the next operation.

(9) Next, when the time of TIM6 has passed, the document sheet feeding clutch CL1 and the driving motor M2 are turned on. A third document D3 is fed out and when its leading edge is detected by the document passage detection sensor PS5, the document D3 is temporarily stopped.

By the time in which this condition is created, in the copying machine main body 1, the main body driving motor, the recording sheet feeding clutch and the document sheet conveyance clutch are started. Then, the recording sheet is fed out from the recording sheet feeding section, and a first recording sheet is ready for the next operation on the registration roller provided near the image forming section.

At this time, since the no-document sensor PS1 detects that a subsequent document D4 exists on the stacking tray 110 of the automatic document feeder 10, the subsequent recording sheets corresponding to these documents are fed out successively in predetermined timing.

The document D1 is exposed in the stop position on the platen glass 21 by an exposure lamp 23 of the optical scanning exposure system 2, and the document image is formed on a photoreceptor drum 31 through lenses and mirrors. (Refer to FIG. 4 (E).)

The same exposure operations as the foregoing are repeated for a predetermined number of copying sheets, and thus, a series of copying processes corresponding to the document D1 are carried out.

(10) After the exposure operation of the document D1 has been completed, when the driving motor M2, the document sheet delivery motor M3 and the document sheet conveyance clutch CL2 are turned on, the document sheet conveyance belt 141 is rotated. The exposed document D1 passes through the reversal sheet delivery section 15 and is delivered onto a document sheet delivery tray 158 provided outside the apparatus. At the same time, the subsequent document D2 which is preparing for the next operation, is moved on the platen glass 21 and stopped at the stop position by the document stopper 22. Further, the subsequent document D3 is conveyed to and stopped at the stop position with the same operation as the above. (Refer to FIG. 4 (F).)

(11) While the exposure operation on the document D2 is being conducted, the subsequent document D4 is fed.

(12) After the exposure operation on the document D2 has been completed, the exposed document D2 is delivered, and at the same time, the document D3 preparing for the next operation on the platen glass 21, is conveyed to the exposure position. At this time, the subsequent document D4 is conveyed to the stand-by position and prepared for the next operation. (Refer to FIG. 4 (G).)

After this time, the foregoing document feeding and conveying operations are repeated. When the last document (DS) has been exposed and delivered, all documents are stacked on the document delivery tray. Corresponding to the document conveyance, the recording sheet feeding operations are successively conducted. When the existence of the subsequent document is previously detected by the no-document sensor PS1 at the time of the document flying-feeding operation, the recording sheet can be previously fed by the detection signal.

For example, while the document D3 is being exposed on the platen glass 21, the feeding operation of a document D5 after the subsequent document D4 is preliminarily completed, and the no-document sensor PS1 detects the existence of a document D6, and the recording sheet corresponding to the document D6 is preliminarily fed.

After the no-document sensor PS1 has detected the passage of the trailing edge of the document D5, when the sensor detects no subsequent document, the sensor sends the signal to the copying machine main body, and thereby the subsequent recording sheet feeding operation can be stopped at once.

Figure 6:
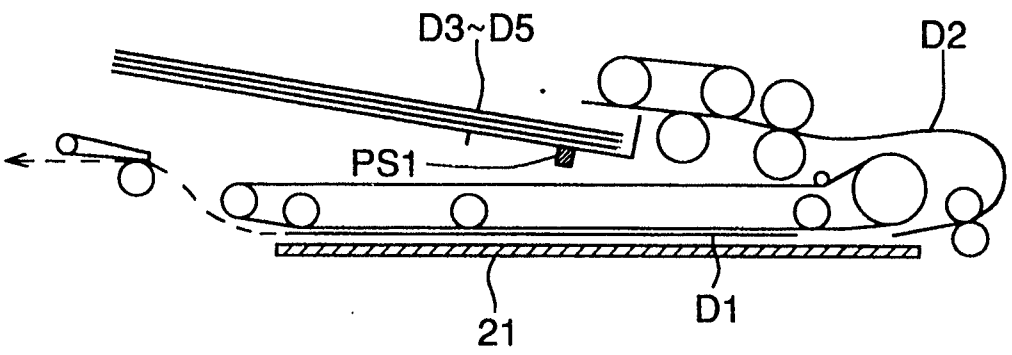
FIG. 6 is an illustration showing the movement of a large sized document in the automatic document feeder according to the present invention.

FIG. 6 is an illustration showing the condition under which large sized documents are accommodated in the automatic document feeder and conveyed. In the case where large sized documents (for example, sizes A3, B4 or the like) are flying-fed, when the preceding document D1 exists on the platen glass 21, only the subsequent document D2 is preliminarily fed in the feeding path. The no-document detection sensor PS1 detects the existence of the subsequent one document, and sends a preliminary recording sheet feeding signal for the subsequent recording sheet to the recording sheet feeding means of the copying machine main body 1.

The conveyance processes of a single sided document are described above, and in a copying mode of a two sided document (RADF), the apparatus of which is provided with a reversal passage, document sheet conveyance characteristics can be improved by the same operation as the above. Further, it is clear that the same operations as described above can be conducted also in an ADF of the type in which the document is moved and exposed, other RADFs, or a circulating type document feeder (RDH).

As described above, in the image forming apparatus equipped with the automatic document feeder of the present invention, feeding of the subsequent document and delivery of the preceding document are conducted during the document exposure, and therefore document conveyance time can be reduced. Further, when the existence of the subsequent document after the document which is being exposed, is detected by a document existence detection means in a short conveyance path, and a recording sheet corresponding to the subsequent document is preliminarily fed, the recording sheet feeding time can be reduced in the image forming apparatus having a long recording sheet conveyance path, so that copying productivity can be greatly improved.

What is claimed is:

1. An apparatus for forming an image, the apparatus comprising:

a document stand on which a plurality of documents can be placed;

means for detecting the presence of the documents on said document stand, means for scanning an original image on each document;

means for forming an image on the basis of the scanned original image form each document, wherein the image is formed on a recording sheet;

means for conveying the documents from said document stand individually to said scanning means so that each document has a leading edge and a trailing edge when conveyed, said conveying means having a passage in which a waiting position is provided so that, when a first document is located at said scanning means, a second document is located at said waiting position, wherein said detecting means is arranged relative to said passage such that, when said second document is located at said waiting position, the trailing edge of said second document has passed said detecting means; and means for feeding recording sheets to the image forming means, wherein, before the second document is stopped at the waiting position and after a third document is detected by the detecting means, the feeding means starts feeding a subsequent recording sheet to be used for said third document.

2. The apparatus of claim 1, wherein said detecting means is a non-contact type sensor. The apparatus of claim 1, wherein said detecting means is a non-contact type sensor.

* * * * *

UNITED STATES PATENT AND TRADEMARK OFFICE

CERTIFICATE OF CORRECTION

PATENT NO. : 5,333,043

DATED : July 26, 1994

INVENTOR(S) : Yasushi YAMADA

It is certified that error appears in the above-identified patent and that said Letters Patent is hereby corrected as shown below:

On title page, item [57] ABSTRACT, line 1, change "document" to --documents--.

Last line of Abstract, change "have" to —has—.

Claim 1, column 10, line 31 change "form" to --from--.

Claim 2, column 10, line 52 delete "The apparatus of"; line 53 and penultimate line delete entirely.

Signed and Sealed this

Twenty-fifth Day of April, 1995

Bruce Lehman

*Attest:*

BRUCE LEHMAN

*Attesting Officer*

*Commissioner of Patents and Trademarks*